US006722910B2

(12) United States Patent
Kajinuma

(10) Patent No.: US 6,722,910 B2
(45) Date of Patent: Apr. 20, 2004

(54) ELECTRICAL CONNECTOR

(75) Inventor: Shuji Kajinuma, Kanagawa (JP)

(73) Assignee: Tyco Electronics AMP, K.K., Kanagawa (JP)

( * ) Notice: Subject to any disclaimer, the term of this patent is extended or adjusted under 35 U.S.C. 154(b) by 0 days.

(21) Appl. No.: 10/126,724

(22) Filed: Apr. 19, 2002

(65) Prior Publication Data

US 2002/0155744 A1 Oct. 24, 2002

(30) Foreign Application Priority Data

Apr. 19, 2001 (JP) ..... 2001-121559

(51) Int. Cl.[7] ..... H01R 4/50
(52) U.S. Cl. ..... 439/342; 439/526
(58) Field of Search ..... 439/342, 259, 439/263, 264, 265, 266, 268

(56) References Cited

U.S. PATENT DOCUMENTS 6,217,361 B1 * 4/2001 Murr ..... 439/342
6,296,506 B1 * 10/2001 Mizumura et al. ..... 439/342
6,347,951 B1 * 2/2002 Murr ..... 439/342
6,350,142 B1 * 2/2002 Shirai et al. ..... 439/342
6,435,893 B1 * 8/2002 Kasahara ..... 439/342

FOREIGN PATENT DOCUMENTS

JP 2-54632 11/1990

* cited by examiner

*Primary Examiner*—Hien Vu
(74) *Attorney, Agent, or Firm*—Barley Snyder

(57) ABSTRACT

The electrical connector is provided with a locking member which is disposed on the base housing so that the locking member can move between an open position and a locking position in a direction that is perpendicular to the direction of movement of the slide member. The locking member is positioned in the open position when the slide member is in a first position. Furthermore, when the slide member is in a second position, in which pins of an electronic component and contacts of the electrical connector are in contact, the locking member moves to the locking position and contacts the slide member, so that the movement of the slide member is checked. Furthermore, an engaging part, which engages with a tool that is used to move the locking member, is disposed in the upper surface of the locking member.

17 Claims, 9 Drawing Sheets

ELECTRICAL CONNECTOR

FIELD OF THE INVENTION

The present invention relates to an electrical connector which is used to connect electronic components such as ICs (integrated circuits) having numerous pins to a circuit board, and more specifically relates to a ZIF (zero insertion force) type electrical connector which connects and separates contacts and pins of electronic components by a tool actuated slide member.

BACKGROUND OF THE INVENTION

Recently, there has been a demand for improved performance in electronic components resulting in microprocessors having extremely large numbers of pins or leads.

In order to reduce the insertion force that must be applied to the pins in the mounting of such ICs ZIF connectors have been widely used for electrically connecting such ICs to circuit boards. Furthermore, slide members have been utilized in such connectors to engage and separate contacts and the pins of ICs from their respective sockets.

For example, the electrical connector shown in FIGS. 7 through 9 (see Japanese Patent Application Kokoku No. H2-54632) is a known as a conventional electrical connector of this type.

This electrical connector 100 comprises an insulating housing 110 which has a pair of partition walls 112 that rise from both sides of a base. A plurality of IC pin receiving holes 113 extend at a specified pitch along the insides of the respective partition walls 112 of the housing 110. A plurality of electrical contacts 120 are secured in these IC pin receiving holes 113. Each contact 120 has an retention barb 123 which is secured in the corresponding IC lead insertion hole 113, a pin section 121 which is connected to the circuit board (not shown in the figures), and a contact section 122 which resiliently contacts a pin. 141 of the IC 140. A protrusion 124 is also formed on the plate surface of each contact 120 in the vicinity of the contact section 122.

An insulating slide member 130 is disposed between the partition walls 112 and is movable along the pair of partition walls 112 of the housing 110 between a first position shown in FIG. 9(*a*) and a second position shown in FIG. 9(*b*).

When this slide member 130 is in the first position, the plurality of pins 141 disposed on the IC 140 are inserted into the IC pin receiving holes 113 of the housing 110. In this first position, as is shown in FIG. 9(*a*), the protruding parts 124 of the electrical contacts 120 are positioned inside the plurality of recesses 131 formed in both side walls of the slide member 130, and the pins 141 are not in contact with the contact parts 122 of the contacts 120. Accordingly, there is no load on the pins 141, so that the IC 140 is inserted with zero force.

On the other hand, when the slide member 130 is in the second position, as is shown in FIG. 9(*b*), portions of both side walls of the slide member 130 push the protruding parts 124 of the contacts 120 to the outside, so that the pins 141 contact the contact parts 122. The slide member 130 maintains this second position as a result of the contact force of a plurality of pairs of contact parts 122 whose protruding parts 124 contact both side walls of the slide member 130.

For the purpose of moving the slide member 130 between the first and second positions tool insertion recesses 114 and 132 are respectively formed in the base of the housing 110 and in the slide member 130. In the first position shown in FIG. 9(*a*), when a tool A such as a screwdriver is inserted into the tool insertion recesses 132 and 114 in that order, and this tool A is rotated in the direction indicated by the arrow in FIG. 9(*a*), the slide member 130 is urged into the second position shown in FIG. 9(*b*). Likewise, in this second position, when the tool A is inserted into the tool insertion recesses 132 and 114 in that order, and this tool A is rotated in the direction indicated by the arrow in FIG. 9(*b*), the slide member 130 is urged into the first position shown in FIG. 9(*a*).

However, a problem has been encountered in this conventional electrical connector 100. Specifically, in the second position of the slide member 130, the slide member 130 maintains this second position only by virtue of the contact force of a plurality of pairs of contact parts 122 which have protruding parts 124 that contact both side walls of the slide member 130. Accordingly, in the second position the slide member 130 may move if an impact or other unintended force is applied to the electrical connector 100. When this slide member 130 moves from the second position, faulty or intermittent contact may occur between the pins 141 of the IC 140 and the contact parts 122 of the contacts 120.

SUMMARY

Accordingly, the present invention was devised in order to address this problem and an object of the present invention is to provide an electrical connector in which the slide member is securely locked in a position in which the pins of the electronic component and the contacts of the electrical connector are in contact, so that there is no movement of the slide member caused by impacts.

The electrical connector of the present invention application comprises numerous contacts that are connected to a circuit board, a base housing in which the contacts are inserted and held, and a slide member which has a plurality of terminal insertion holes into which a plurality of pins of an electronic component are inserted. This slide member is disposed so that it can be moved between a first position and a second position over the base housing. The pins are inserted into the terminal insertion holes when the slide member is in the first position, and the pins that have been inserted into the terminal insertion holes contact the contacts when the slide member is in the second position. A locking member is disposed on the base housing so that this locking member can move between an open position and a locking position perpendicular to the direction of movement of the slide member. The locking member is positioned in the open position when the slide member is in the first position, the locking member moves to the locking position to contact the slide member and prevent movement of the slide member when the slide member is in the second position. An engaging part disposed on the upper surface of the locking member engages the tool that is used to move the locking member.

BRIEF DESCRIPTION OF THE DRAWINGS

The invention will now be described by way of example with reference to the accompanying figures of which:

FIG. 9(*a*) is a partial plan view showing the slide member in the first position, and FIG. 9(*b*) is a partial plan view showing the slide member in the second position.

DETAILED DESCRIPTION OF THE PREFERRED EMBODIMENT

Figure 1:
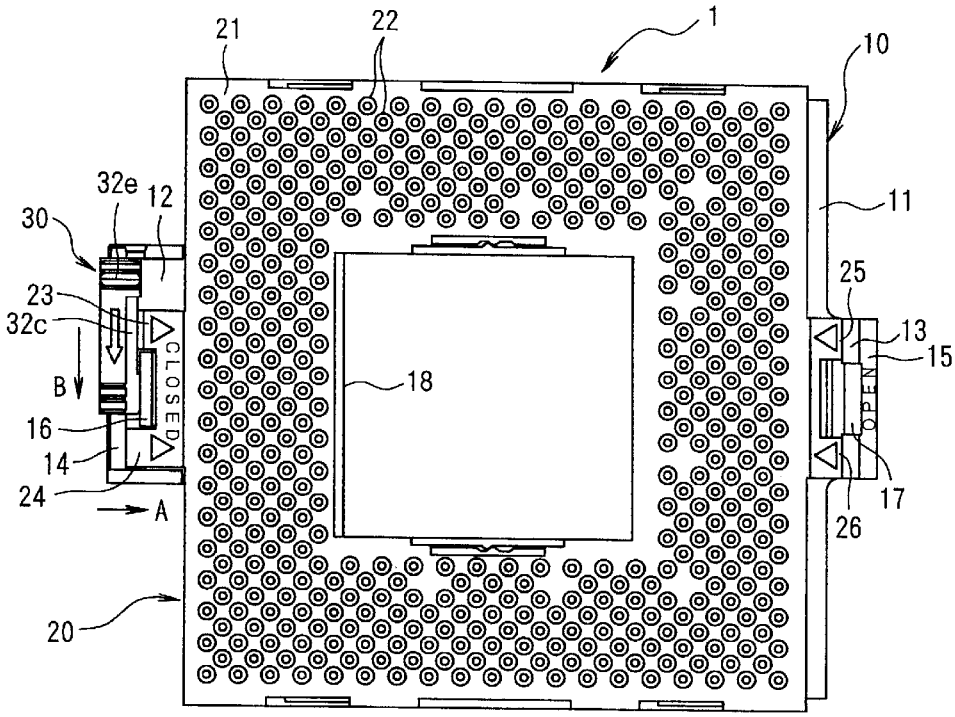
FIGS. 1(*a*)–1(*b*) show plan views of a working configuration of the electrical connector of the present invention wherein FIG. 1(*a*) shows the locking member in a open position, and FIG. 1(*b*) shows the locking member in a locking position.
Figure 1:
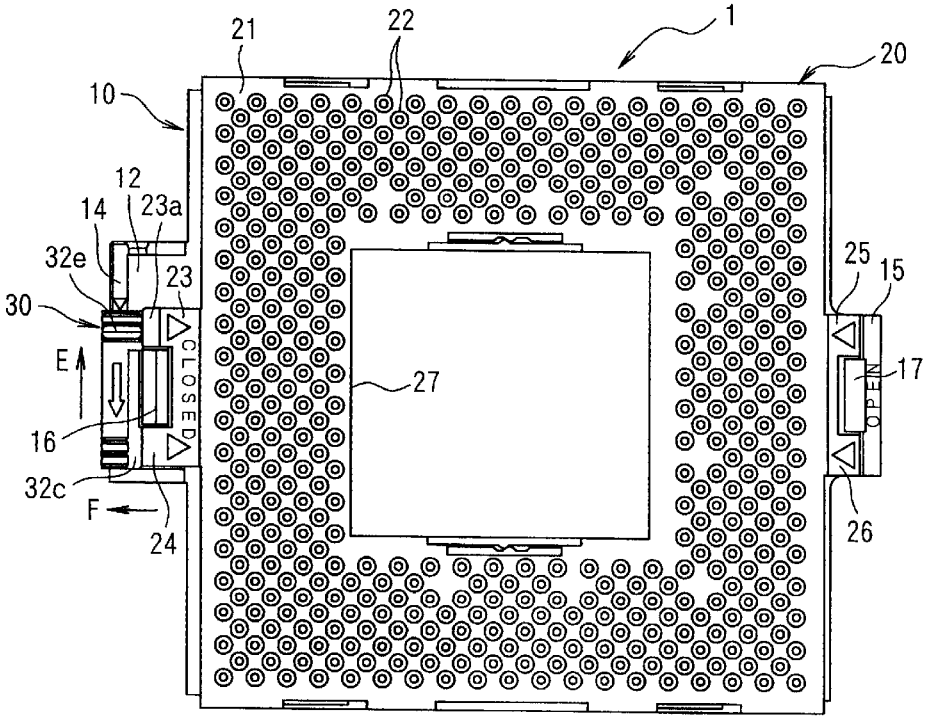

The present invention will now be described with reference to the attached figures. The electrical connector 1 shown in FIG. 1 is applied to an IC socket which is used to connect the numerous pins formed on a PGA (pin grid array) IC package to a circuit board (not shown in the figures).

The electrical connector 1 has a base housing 10 in which a plurality of contacts 40 that are soldered to the circuit board are inserted and held, a movable slide member 20 and a locking member 30 which is movable generally perpendicular to the direction of movement of the slide member 20. The slide member 20 and locking member 30 can move between a first position shown in FIG. 1(*a*) and a second position shown in FIG. 1(*b*).

Here, the base housing 10 is formed to have a substantially rectangular housing main body 11 and a plurality of contact accommodating holes extending therein. A plurality of contacts are inserted and held inside the plurality of contact accommodating holes disposed around the periphery of a substantially rectangular hole 18. A locking member base 12 protrudes from the left end portion of the housing main body 11, and a stop 13 protrudes from the right end portion of the housing main body 11. The base housing 10 may be formed by molding a thermoplastic resin such as a liquid crystal polymer or other suitable insulative materials.

Figure 2:
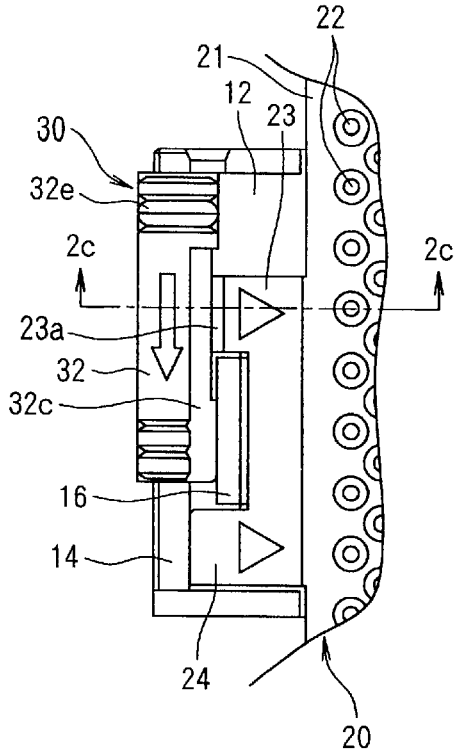
FIGS. 2(*a*)–2(*c*) show detailed views of the locking member of the electrical connector shown in FIG. 1 wherein FIG. 2(*a*) is a partial enlarged plan view showing the locking member in the open position, FIG. 2(*b*) is a partial enlarged left-side view of the locking member in the open position, and FIG. 2(*c*) is a sectional view along line 2*c*–2*c* of FIG. 2(*a*).
Figure 2:
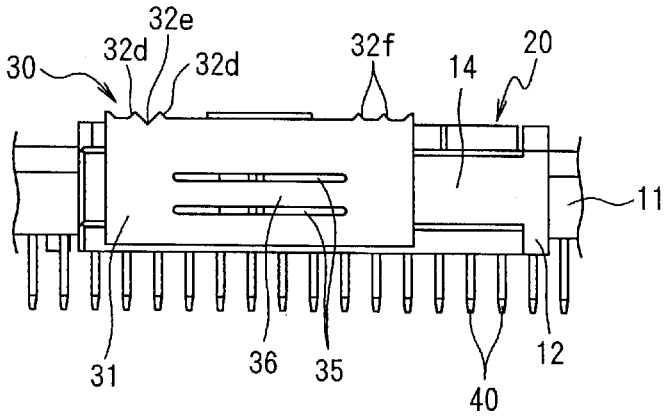
Figure 2:
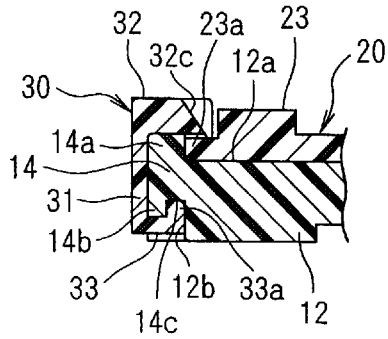
Figure 3:
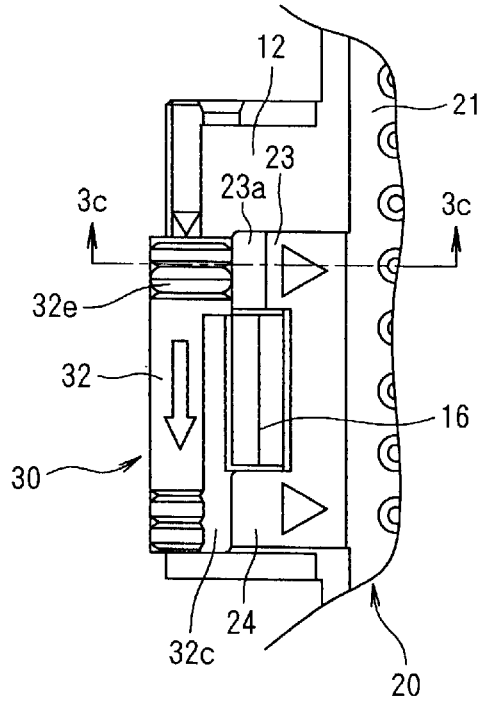
FIGS. 3(*a*)–3(*c*) show detailed views of the locking member of the electrical connector shown in FIG. 1 wherein FIG. 3(*a*) is a partial enlarged plan view showing the locking member in the locking position, FIG. 3(*b*) is a partial enlarged left-side view of the locking member in the locking position, and FIG. 3(*c*) is a sectional view along line 3*c*–3*c* of FIG. 3 (*a*).
Figure 3:
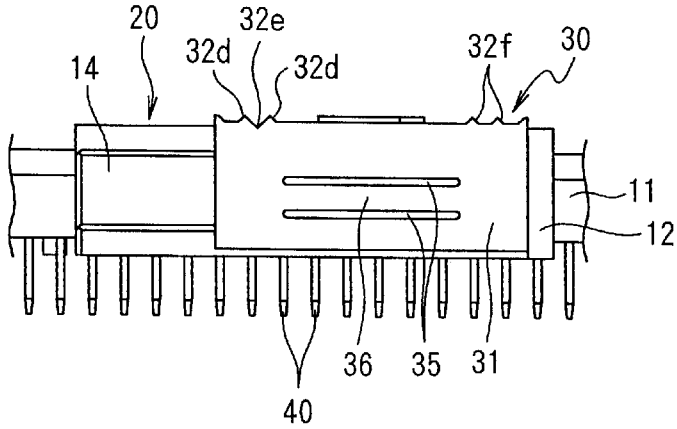
Figure 3:
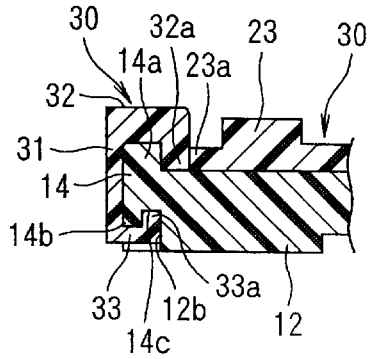
Figure 4:
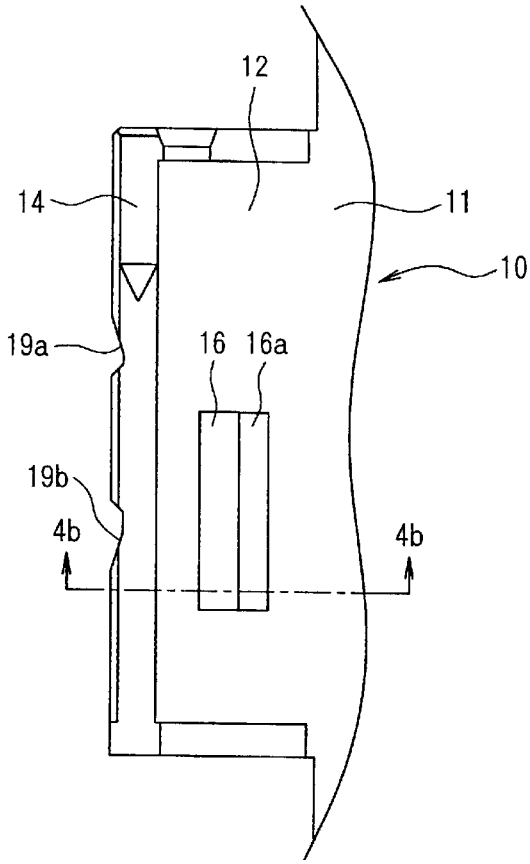
FIGS. 4(*a*)–4(*c*) show the housing used in the electrical connector shown in FIG. 1 wherein FIG. 4(*a*) is a partial enlarged plan view, FIG. 4(*b*) is a sectional view along line 4*b*–4*b* of FIG. 4(*a*), and FIG. 4(*c*) is a partial enlarged left-side view.
Figure 4:
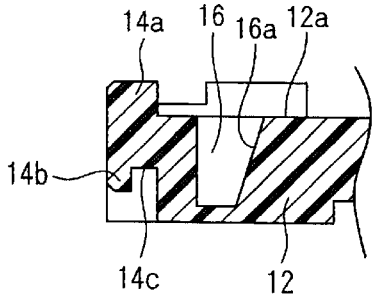
Figure 4:
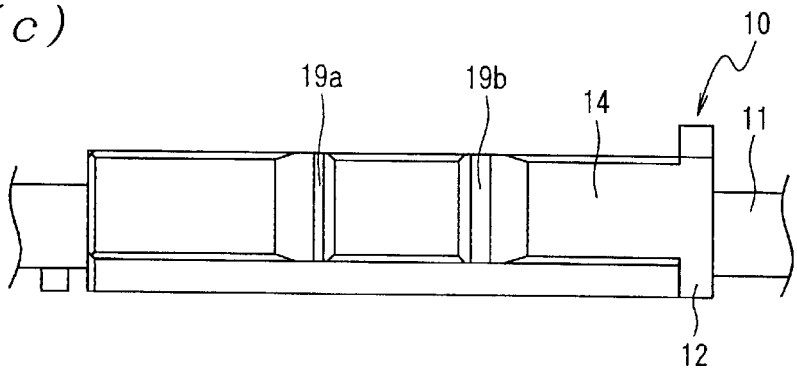

As is shown in FIGS. 2 through 4, a rail 14 which guides the movement of the locking member 30 is disposed on the leftmost end portion of the locking member base 12. This rail 14 is equipped with a first rectilinear protrusion 14*a* which protrudes upward from the upper surface 12*a* of the locking member base 12, and a second rectilinear protrusion 14*b* which is formed from the end surface 12*b* of the locking member base 12 with a groove 14*c* interposed therebetween. An engaging recess 16 which engages with a tool is formed in the upper surface 12*a* at a point slightly to the inside of the leftmost end portion of the locking member base 12. The right-side surface of the engaging recess 16 forms an inclined surface 16*a* which is inclined from the upper surface 12*a* toward the bottom. When the slide member 20 is to be moved, a tool such as a flat-head screw driver is inserted into the engaging recess 16. Meanwhile, as is shown in FIG. 1, a protrusion 15 prevents the slide member 20 from moving too far to the right. This protrusion 15 protrudes upward from the rightmost end portion of the stop 13. A separate engaging recess 17 which engages with the tool is formed in the upper surface of the stop 13.

As is shown in FIG. 1, the slide member 20 has a substantially rectangular main body 21 in which a plurality of terminal insertion holes 22 that can accommodate the plurality of pins (not shown in the figures) of a PGA type IC package are formed around the periphery of a substantially rectangular hole 27. The main body 21 is disposed over the base housing 10 so that this main body 21 can move in the left-right direction between the first position shown in FIG. 1(*a*) and the second position shown in FIG. 1(*b*). A pair of projections 23, 24 which protrude to the left at a specified spacing from each other and are formed in the approximate center of the left end portion of the main body 21. Conversely, a second pair of projections 25, 26 protrude to the right at a specified spacing from each other and are formed in the approximate center of the right end portion of the slide member 20. The first projection 23 extends to the left along the upper surface 12*a* of the locking member base 12 from the left end portion of the main body 21. This first projection 23 protrudes further upward than the main body 21. The left end portion of the first projection 23 forms a thin plate 23*a* which has a thickness that is comparable to the thickness of the main body 21. Furthermore, the second projection 24 extends to the left along the upper surface 12*a* of the locking member base 12 from the left end portion of the main body 21. This second projection 24 also protrudes further upward than the main body 21, however, no thin plate is formed on the tip end of the second projection 24.

Figure 5:
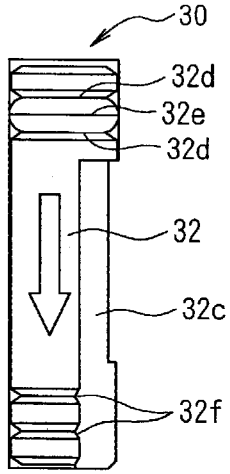
FIGS. 5(*a*)–5(*f*) show the locking member used in the electrical connector shown in FIG. 1 wherein FIG. 5(*a*) is a plan view, FIG. 5(*b*) is a front view, FIG. 5(*c*) is a right-side view, FIG. 5(*d*) is a sectional view along line 5*d*–5*d* in FIG. 5(*c*), FIG. 5(*e*) is a rear side view, and FIG. 5(*f*) is a left-side view.
Figure 5:
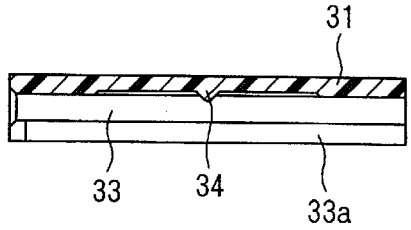
Figure 5:
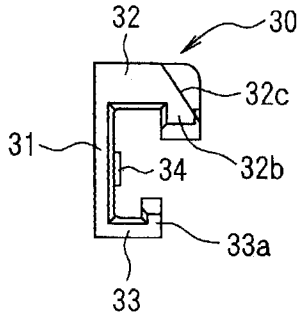
Figure 5:
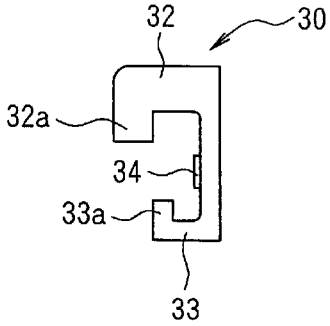
Figure 5:
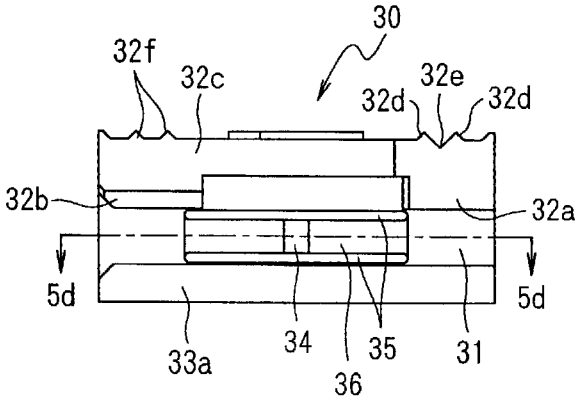
Figure 5:
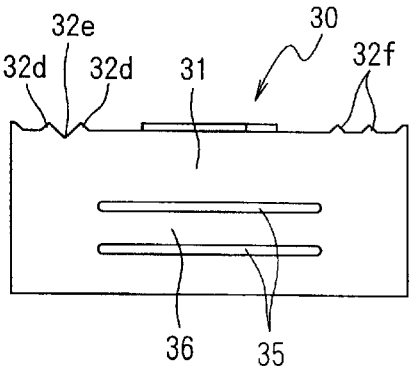

Referring now to FIGS. 2, 3 and 5, the locking member 30 comprises a substantially rectangular planar member 31 which is disposed along the left end surface of the rail 14. The locking member 30 may be formed by molding a thermoplastic resin such as a liquid crystal polymer or other suitable insulative materials.

On both ends of the first plate member 32, a pair of rails 32*a* and 32*b* extend downward along the inside surface of the first rectilinear protrusion 14*a*. A tapered surface 32*c* angled from the upper surface toward the right end surface is formed on the right end portion of the first plate member 32. The tapered surface 32*c* extends from the rear end surface (i.e., the lower end surface in FIG. 2(*a*)) of the locking member 30 to a point just before the rail 32*a*. This tapered surface 32*c* guides the insertion of the tool. This tapered surface 32*c* also has the function of avoiding contact with the tool when the tool is removed from the engaging recess 16, so that the tool is prevented from biting into the locking member 30. Two peaked projections 32*d* are disposed to protrude from the upper surface of the front end portion of the first plate member 32. An engaging part 32*e* is formed to be recessed between the two peaked projections 32*d* and to engage the tool T that is used to move the locking member 30. Furthermore, two peaked projections 32*f* are disposed to protrude from the upper surface of the rear end portion of the first plate member 32. These peaked projections 32*d* and 32*f* are used to prevent slipping in cases where the locking member 30 is operated by the fingers.

A rail 33*a* which is inserted into the groove 14*c* along the inside surface of the second rectilinear protrusion 14*b* extends upward on the right end portion of the second plate member 33. As a result of the pair of rails 32*a* and 32*b* being disposed along the inside surface of the first rectilinear protrusion 14*a*, and the rail 33*a* being inserted into the groove 14*c*, the locking member 30 is disposed on the base housing 10 so that the locking member 30 can move along the first rectilinear protrusion 14*a* and second rectilinear protrusion 14*b*.

In order to anchor the locking member 30 with respect to the base housing 10 in the open position shown in FIG. 1(*a*) and locking position shown in FIG. 1(*b*), an anchoring projection 34 extends from the planar member 31 shown in FIG. 5. Slits 35 are formed in the upper and lower sides of the anchoring projection 34, so that the anchoring projection 34 protrudes from an elastic part 36 which is fastened at both ends and which is positioned between the slits 35. As best shown in FIGS. 4(*a*) and 4(*c*), a first anchoring recess 19*a* in which the anchoring projection 34 is anchored in the open position of the locking member 30, and a second anchoring recess 19*b* in which the anchoring projection 34 is anchored in the locking position of the locking member 30, are formed along the left end surface of the rail 14. It would also be possible to dispose an anchoring recess on the side of the locking member 30 and anchoring projections on the side of the base housing 10 in order to anchor the locking member 30 in the open position and locking position with respect to the base housing 10.

Next, the method used to connect the numerous pins of the PGA type IC package to the circuit board will be described.

In this connection operation, the contacts 40 of the electrical connector 1 are first soldered to the circuit board. Next, with the main body 21 of the slide member 20 in the first position shown in FIG. 1(*a*), the plurality of pins of the IC package are inserted into the terminal insertion holes 22. In this case, the pins do not contact the contacts, so that the IC package is mounted with zero insertion force. When the slide member 20 is in the first position, the locking member 30 is positioned in the open position, and the anchoring projection 34 of the locking member 30 is anchored in the first anchoring recess 19*a* of the base housing 10. Furthermore, in this open position, the end of the thin plate 23*a* of the first projection 23 of the slide member 20 contacts the inside surface (right surface) of the first rectilinear protrusion 14*a* of the rail 14 formed on the base housing 10, so that the movement of the slide member 20 to the left is prevented as shown in FIG. 2(*c*).

Afterward, a tool (not shown in the figures) such as a flat-head screw driver is inserted into the engaging recess 16 formed in the base housing 10, and is caused to contact the left end portion of the slide member 20. The screwdriver is rotated in the direction indicated by the arrow A shown in FIG. 1(*a*), so that the slide member 20 is moved to the right. As a result, the slide member 20 is positioned in the second position shown in FIGS. 1(*b*) and 3. When the slide member 20 moves into the second position, the pins on the PGA package contact the contacts, so that these pins are electrically connected to the circuit board.

During the insertion of the tool into the engaging recess 16, the tip end of the tool is guided along the tapered surface 32*c* formed on the locking member 30, so that the insertion of the tool is facilitated. Furthermore, after the slide member 20 has been moved into the second position, it is necessary to remove the tool from the engaging recess 16. Biting of the tool into the locking member 30 is avoided by means of the tapered surface 32*c*.

Figure 6:
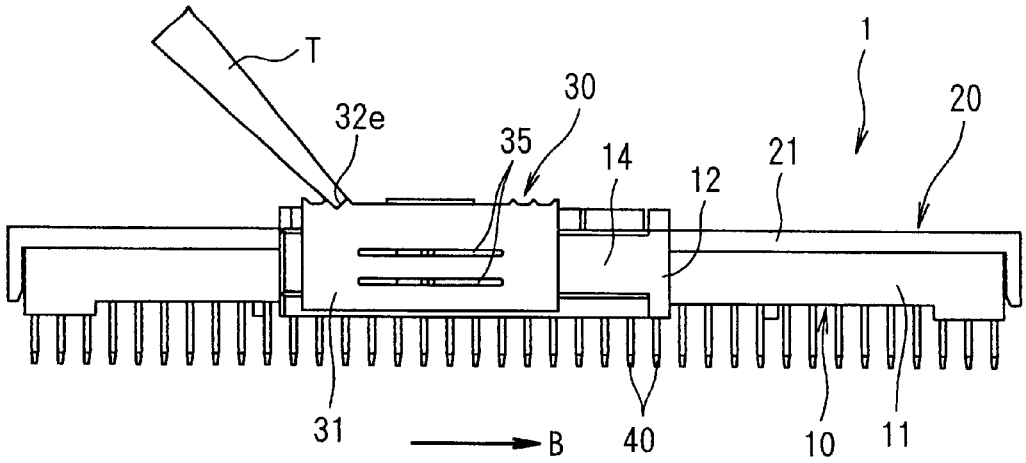
FIGS. 6(*a*)–6(*b*) show left-side views of the electrical connector together with the tool wherein FIG. 6(*a*) shows the locking member in the open position and FIG. 6(*b*) shows the locking member in the locking position.
Figure 6:
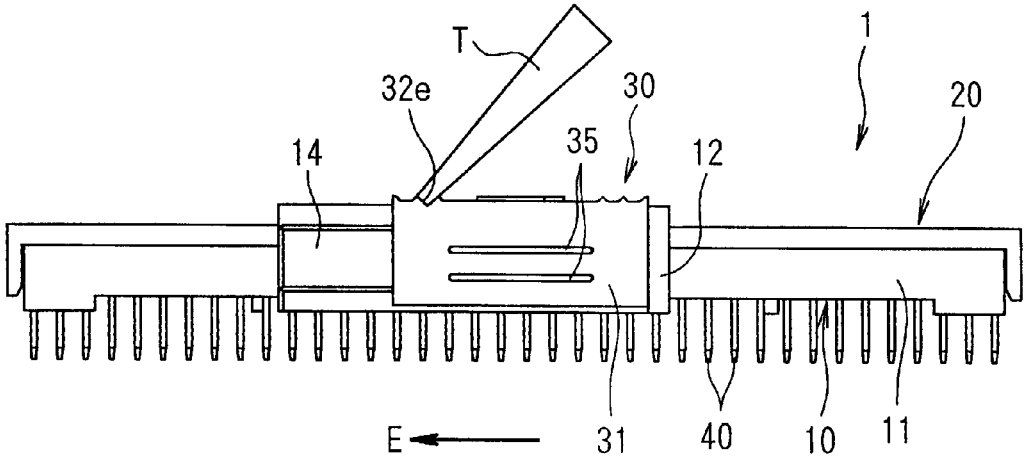

Next, as is shown in FIG. 6(*a*), the end of the tool T is engaged with the engaging part 32*e* formed in the upper surface of the locking member 30, and the locking member 30 is moved in the direction indicated by the arrow B in FIGS. 1(*a*) and 6(*a*). As a result, the locking member 30 is positioned in the locking position shown in FIGS. 1(*b*), 3 and 6(*b*). In this locking position, the anchoring projection 34 of the locking member 30 is anchored in the second anchoring recess 19*b* of the base housing 10. In the anchoring of the anchoring projection 34 in the second anchoring recess 19*b*, the anchoring projection 34 contacts the end surface of the rail 14, so that the elastic part 36 is temporarily displaced outward. Then, as a result of the anchoring projection 34 entering the second anchoring recess 19*b*, the elastic part 36 returns to its original position. Furthermore, in this locking position, as is shown in FIG. 1(*b*), the third projection 25 and fourth projection 26 of the slide member 20 contact the protrusion 15 of the base housing 10, so that the movement of the slide member 20 in the rightward direction is checked. Meanwhile, in this locking position, as is shown in FIGS. 3(*a*) and 3(*c*), the end surfaces of the first projection 23 and second projection 24 of the slide member 20 contact the right end surfaces of the rails 32*a* and 32*b* of the locking member 30, so that the movement of the slide member 20 in the leftward direction is limited. As a result, the slide member 20 is securely locked by the locking member 30 in the second position, so that there is no movement of the slide member 20 even if an impact is applied to the slide member 20 as a result of the electrical connector being dropped.

During the operation of moving the locking member 30 in the direction indicated by the arrow B, the end of the tool T is engaged with the engaging part 32*e*, and the locking member 30 is moved. Accordingly, the locking member 30 can easily be moved even in cases where access to the locking member 30 by the fingers is difficult because of other components surrounding the electrical connector 1. Furthermore, it is not absolutely necessary to use the tool T in moving the locking member 30.

In the locking position, the tip end surfaces of the first projection 23 and second projection 24 of the slide member 20 contact the right end surfaces of the rails 32*a* and 32*b* of the locking member 30. Accordingly, the slide member 20 is caused to contact the locking member 30 in a stable manner by the two projections, so that there is no biased contact, and the movement of the slide member 20 is thus securely checked.

In order to release the state the pins from the contacts the end of the tool T is first engaged as shown in FIG. 6(*b*) with the engaging part 32*e* formed in the upper surface of the locking member 30 in the locking position shown in FIG. 6(*b*), and the locking member 30 is moved in the direction indicated by the arrow E in FIGS. 1(*b*) and 6(*b*). As a result, the locking member 30 is positioned in the open position shown in FIGS. 1(*a*), 2 and 6(*a*). Then, the tool is inserted into the engaging recess 17 formed in the stop 13 of the base housing 10 and engages the right end portion of the slide member 20. The tool is rotated in the direction indicated by the arrow F in FIG. 1(*b*), so that the slide member 20 is moved into the first position to release the pins from the contacts.

An embodiment of the present invention was described above. However, the present invention is not limited to this embodiment. Various alterations are possible and within the scope of the invention. For example, the electrical connector of the present invention is not limited to cases of application to an IC socket which is used to connect numerous pins formed on a PGA type IC package to a circuit board. The present invention can also be applied to electrical connectors which are used to connect electronic components other than PGA type IC packages, such as ICs that have numerous leads, to circuit boards. Furthermore, the engaging part which is formed in the locking member and which engages with the tool may be a projection instead of an engaging part 32*e* that is recessed in the form of a valley.

What is claimed is:

1. An electrical connector comprising:

numerous contacts that are connected to a circuit board;

a base housing that receives and holds the contacts;

a slide member which has a plurality of terminal insertion holes into which a plurality of pins of an electronic component are inserted, and which is disposed so that the slide member can be moved between a first position and a second position with respect to the base housing, the pins are inserted into the terminal insertion holes when the slide member is in the first position, and the pins being inserted into the terminal insertion holes contact the contacts when the slide member is in the second position; and a locking member is disposed on the base housing so that the locking member can move between an open position and a locking position in the direction perpendicular to a direction of movement of the slide member, the locking member is positioned in the open position when the slide member is in the first position, the locking member moves to the locking position to contact the slide member and prevents movement of the slide member when the slide member is in the second position, and the locking member has an engaging part disposed on an upper surface which engages with a tool that is used to move the locking member; and wherein an engaging recess which engages with the tool that is used to move the slide the slide member is formed in the upper surface of the base housing, and the locking member has a tapered surface which is used to guide the insertion of the tool that is inserted into the engaging recess.

2. The electrical connector of claim 1, further comprising a stop which prevents the slide member from moving beyond the second position.

3. The electrical connector of claim 1, wherein the engaging part has peaked projections that engage the tool.

4. The electrical connector of claim 1, further comprising an anchoring projection that secures the locking member in the open position and the locking position.

5. The electrical connector of claim 4, further comprising an elastic part from which the anchoring projection protrudes that displaces the anchoring projection to secure and unsecure the locking member in the open position and the locking position.

6. The electrical connector of claim 1, further comprising a rail that guides the movement of the locking member between the open position and the locking position.

7. The electrical connector of claim 6, wherein the locking member engages the rail and is c-shaped.

8. The electrical connector of claim 1, wherein the base housing and the locking member are formed by molding a thermoplastic resin.

9. An electrical connector comprising:

a base housing having a plurality of contacts that are connected to a circuit board;

a slide member moveable between a first position and a second position that receives a plurality of pins for contacting the contacts; and a locking member moveable between an open position and a locking position in a direction perpendicular to the slide member, in the locking position the locking member abuts a surface of the slide member such that the slide member is prevented from moving from the locking position to the open position by a surface of the locking member;

wherein the base housing has an engaging recess being formed in the upper surface of the base housing which engages with a tool to move the slide member from the first position to the second position;

whereby when the locking member is in the locking position the slide member is secured in the second position to form an electrical connection between the pins and the contacts.

10. The electrical connector of claim 9, wherein the engaging recess has an inclined surface to facilitate positioning of the tool.

11. The electrical connector of claim 9, further comprising an engaging part having peaked projections for moving the locking member.

12. The electrical connector of claim 9, further comprising a stop which prevents the slide member from moving beyond the second position.

13. The electrical connector of claim 9, further comprising an anchoring projection that secures the locking member in the open position and the locking position.

14. The electrical connector of claim 13, further comprising an elastic part from which the anchoring projection protrudes that displaces the anchoring projection to secure and unsecure the locking member in the open position and the locking position.

15. The electrical connector of claim 9, further comprising a rail that guides the movement of the locking member between the open position and the locking position.

16. The electrical connector of claim 15, wherein the locking member engages the rail and is c-shaped.

17. The electrical connector of claim 9, wherein the locking member is formed by molding a thermoplastic resin.

* * * * *

UNITED STATES PATENT AND TRADEMARK OFFICE

CERTIFICATE OF CORRECTION

PATENT NO. : 6,722,910 B2
DATED : April 20, 2004
INVENTOR(S) : Shuji Kajinuma

Figure 7:
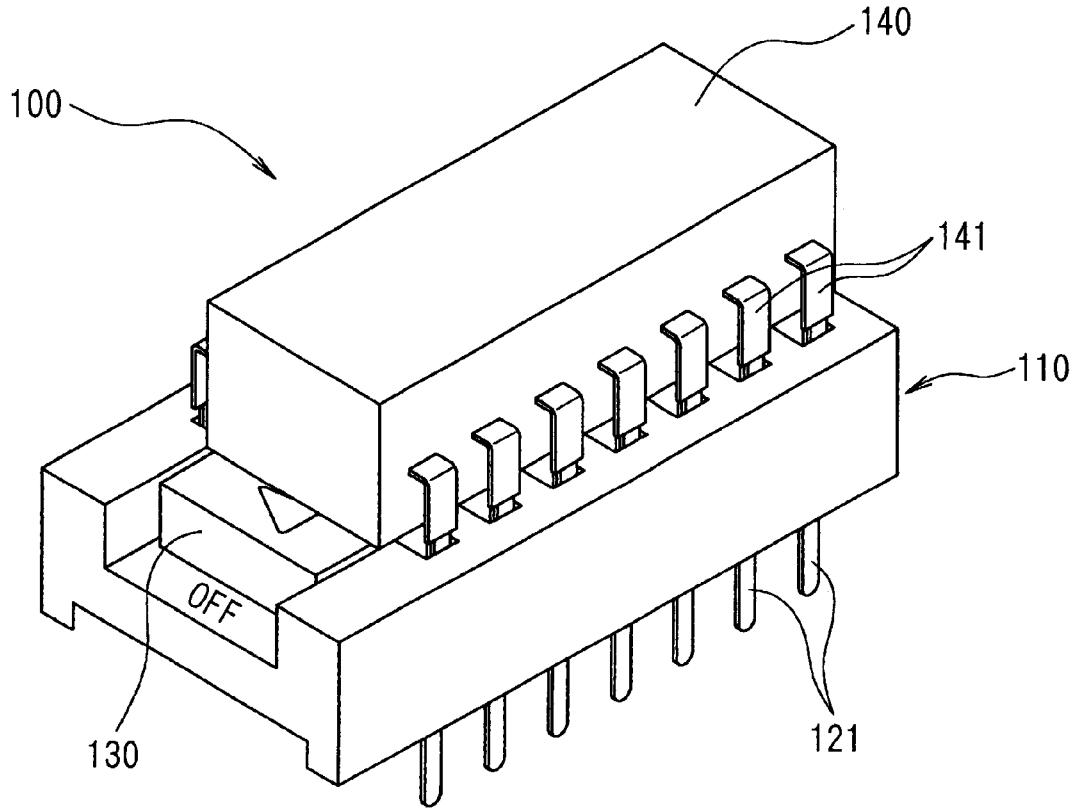
FIG. 7 is a perspective view wherein an IC is mounted on a conventional example of an electrical connector.
Figure 8:
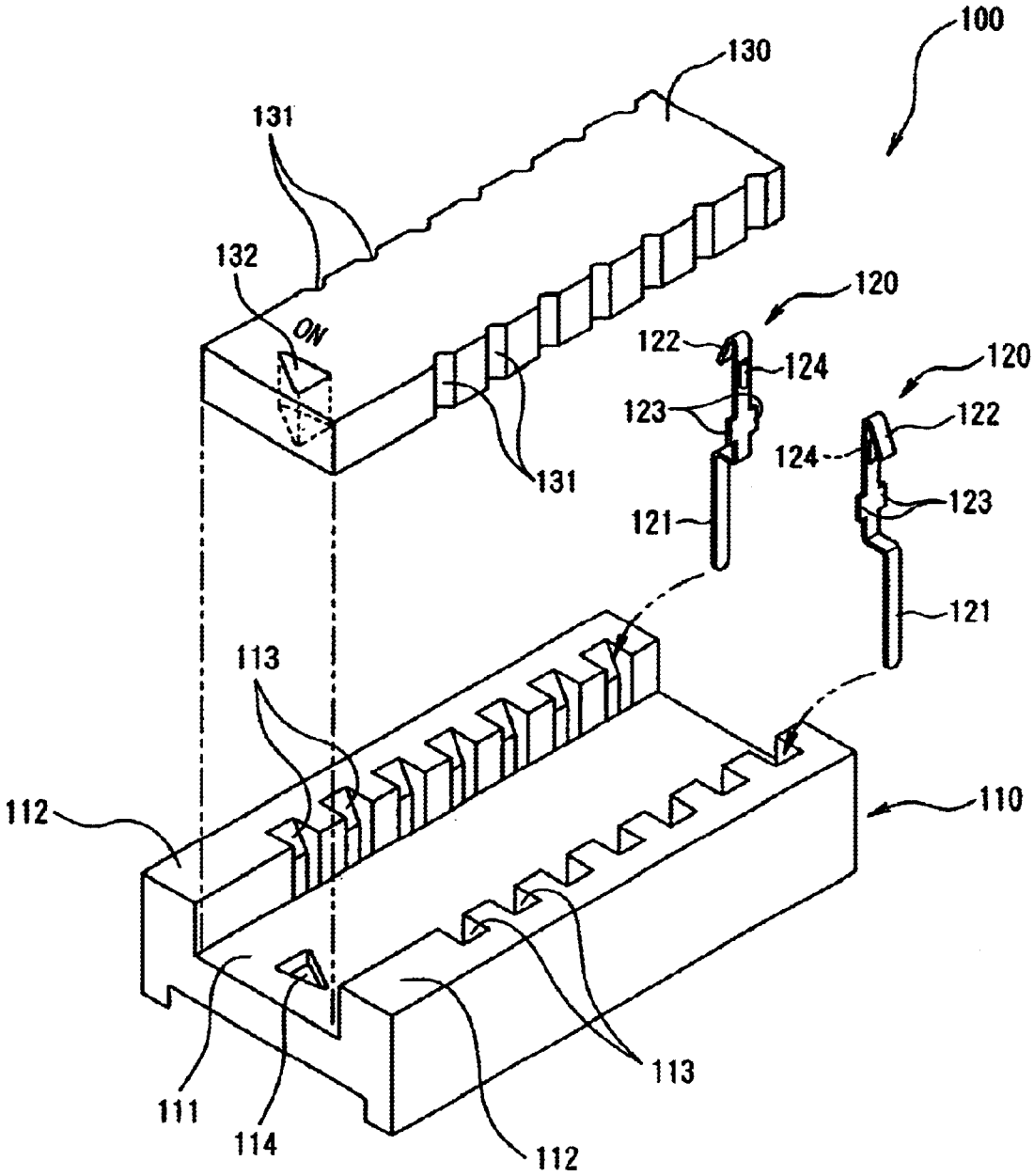
FIG. 8 PRIOR ART
FIG. 8 is an exploded perspective view of the electrical connector shown in FIG. 7.
Figure 9:
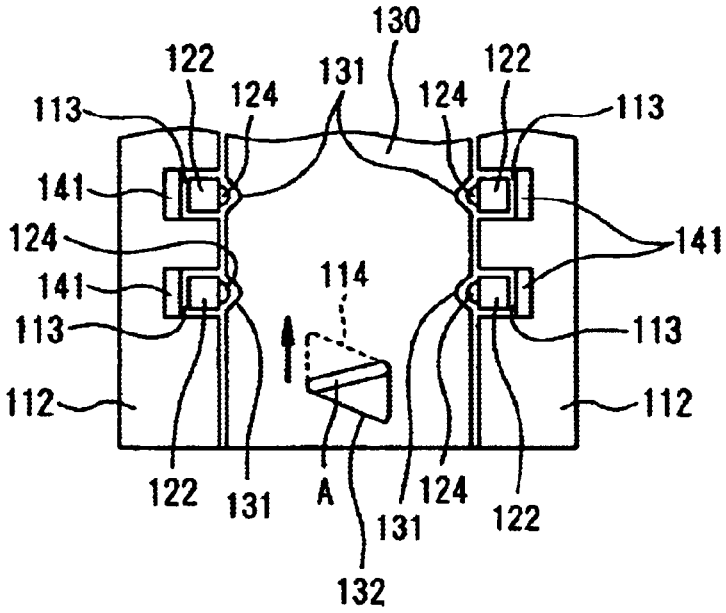
FIG. 9 (a) PRIOR ART
FIGS. 9(*a*)–9(*b*) show the slide member in the electrical connector shown in FIG. 7 in the first position and this slide member in the second position.
Figure 9:
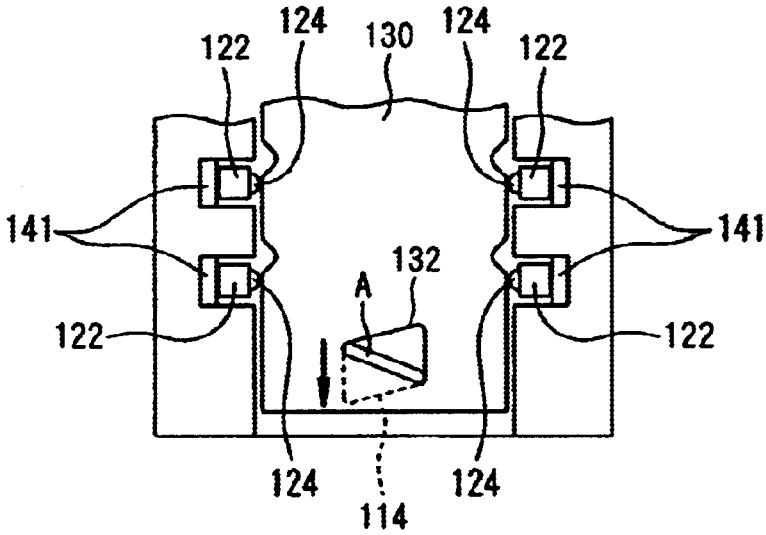
FIG. 9 (b) PRIOR ART

It is certified that error appears in the above-identified patent and that said Letters Patent is hereby corrected as shown below:

Drawings,
Sheet 7, Fig 7, insert the legend -- Prior Art --.

Column 7,
Line 29, cancel “and”.
Line 43, (2nd ocurrence) cancel “the slide”.

Signed and Sealed this

First Day of June, 2004

JON W. DUDAS
*Acting Director of the United States Patent and Trademark Office*